United States Patent [19]

Schreier

[11] 3,973,463

[45] Aug. 10, 1976

[54] DELAYED VIBRATO AND BURBLE CIRCUIT

[75] Inventor: Wilford R. Schreier, Bensenville, Ill.

[73] Assignee: Hammond Corporation, Chicago, Ill.

[22] Filed: Mar. 3, 1975

[21] Appl. No.: 554,436

Related U.S. Application Data

[63] Continuation-in-part of Ser. No. 447,905, March 4, 1974, Pat. No. 3,898,905.

[52] U.S. Cl. ..... 84/1.25

[51] Int. Cl.[2] ..... G10H 1/02; G10H 5/02

[58] Field of Search ..... 84/1.24, 1.25, DIG. 4, 84/DIG. 5

[56] References Cited

UNITED STATES PATENTS

| | | | |
|---|---|---|---|
| 3,288,907 | 11/1966 | George | 84/1.25 |
| 3,479,440 | 11/1969 | Martin et al. | 84/1.25 |
| 3,502,782 | 3/1970 | Schrecongost | 84/1.24 |
| 3,510,565 | 5/1970 | Morez | 84/1.24 X |
| 3,520,984 | 7/1970 | Machanian | 84/1.24 |
| 3,553,338 | 1/1971 | Holman | 84/1.24 X |
| 3,590,133 | 6/1971 | Schwartz et al. | 84/1.24 |
| 3,617,603 | 11/1971 | Wayne, Jr. et al. | 84/1.24 X |
| 3,711,620 | 1/1973 | Kameoka et al. | 84/1.24 |
| 3,812,278 | 5/1974 | Aker | 84/1.25 |

*Primary Examiner*—L. T. Hix
*Assistant Examiner*—Stanley J. Witkowski
*Attorney, Agent, or Firm*—Lowell C. Bergstedt

[57] ABSTRACT

Delayed vibrato and burble circuit in which a single gate between a free running modulating signal oscillator and a master voltage controlled oscillator selectively controls both functions in response to control signals from a keyboard which are processed by parallel time constant circuits.

4 Claims, 2 Drawing Figures

DELAYED VIBRATO AND BURBLE CIRCUIT

This application is a continuation-in-part of my earlier pending application Ser. No. 447,905, filed Mar. 4, 1974, entitled "A Monophonic Electronic Musical Instrument", now U.S. Pat. No. 3,898,905.

This invention relates to electronic musical instruments and more particularly to delayed vibrato and burble circuits therefor. Delayed vibrato is defined as an initial delay in the frequency modulation of the tone signal after key actuation to simulate the performance of a string instrument. Burble is defined as an initial frequency modulation of the tone signal for only a short time after key actuation to simulate a wind instrument.

Prior art delayed vibrato and burble circuits typically involve separate oscillators, gates, and time constant circuits for each function. It is well known to employ a free running vibrato oscillator and a gate circuit which couples the oscillator output to a voltage controlled master oscillator or group of master oscillators. The gate circuit may be a shunt gate or a series gate.

This invention provides an advantageous combined delayed vibrato and burble circuit which requires only one modulating oscillator and one gate circuit. The circuitry is equally adaptable to electronic organs, monophonic and polyphonic synthesizers, and non-keyboard type electronic musical instruments.

Figure 1:
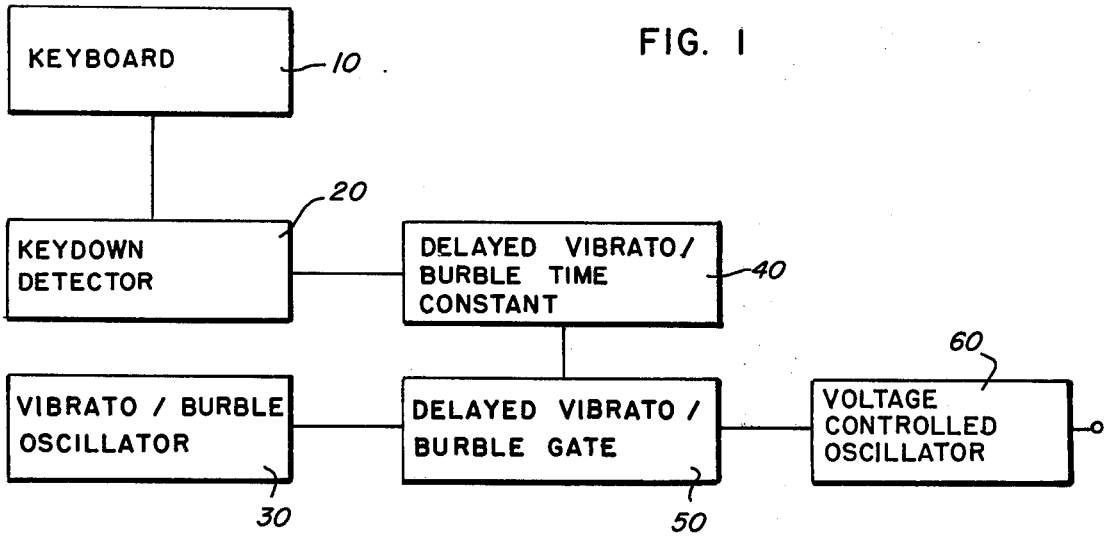
FIG. 1 is a block diagram of a preferred embodiment of this invention.

Referring to FIG. 1, a musical instrument keyboard 10 is coupled to a keydown detector 20 which produces an output control signal during the interval that any key in keyboard 10 is actuated. The control signal from keydown detector 20 is processed by a delayed vibrato/burble time constant circuit 40 which is coupled to delayed vibrato/burble gate 50. A vibrato/burble oscillator 30 produces A.C. output signal which, when coupled through gate 50, modulates a voltage controlled oscillator (VCO) 60. The modulated output of VCO 60 either drives a top octave tone generator arrangement as in the above-referenced co-pending Schreier application or it comprises the primary tone signal of a monophonic synthesizer of the keyboard tuned VCO type.

Figure 2:
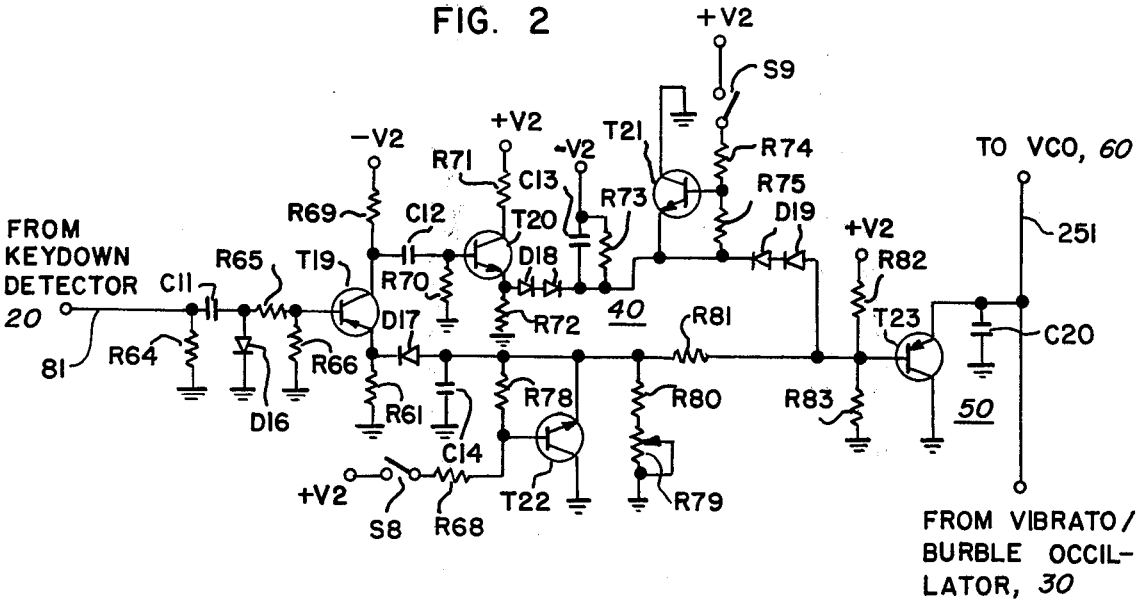
FIG. 2 is a detailed circuit schematic of a preferred embodiment of this invention.

Referring to FIG. 2, transistor T23 with its related circuitry comprises delayed vibrato/burble gate 50.

Transistor T23 stays off continuously when neither delayed vibrato nor burble are desired. To obtain delayed vibrato, transistor T23 is turned on for a short time following each new keydown signal; and to obtain burble, transistor T23 is turned on after a short period of being off. Switches S8 and S9 individually control the delayed vibrato and burble circuit functions, respectively, and together control whether normal vibrato is on or off.

To obtain delayed vibrato, switch S8 is open and S9 closed. With switch S9 closed transistor T21 is on; and as a result, transistor T23 will be biased to an off condition through forward biased diodes D19 and the emitter-collector circuit of transistor T21 unless a negative signal is coupled into its base through resistor R81 to turn transistor T23 on. A negative-going keydown signal on lead 81 is differentiated by capacitor C11 and resistor R66 to produce a negative-going signal spike which momentarily turns on transistor T19, causing the potential on its emitter to drop from zero volts to around −7 volts. Capacitor C14 is rapidly charged through diode D17; and as transistor T19 turns off, capacitor C14 discharges through resistors R79 and R80. The negative voltage across capacitor C14 is coupled to the base of transistor T23 through resistor R81 to turn transistor T23 on. This shunts out the vibrato signal to ground, until the voltage on capacitor C14 rises to the point that transistor T23 turns off. Then the vibrato signal comes on gradually as transistor T23 turns off gradually. With switch S8 open, transistor T22 is off, and the negative signal on capacitor C14 does not get shunted to ground.

To obtain burble, switch S8 is closed and switch S9 is open. With switch S8 closed, transistor T22 is on to ground out the negative voltage otherwise developed on capacitor C14 by the keydown signal. With switch S9 open, transistor T21 is off, and thus the bias path from −V2 potential through resistor R73 and diodes D19 to the base of transistor T23, tends to turn transistor T23 on to shunt out the vibrato signal. However, when a keydown signal occurs, and transistor T19 is momentarily turned on, a positive-going signal on the collector of transistor T19 is differentiated by capacitor C12 and resistor R70 to a positive signal spike which turns on transistor T20 to produce a positive spike signal on its emitter. This positive pulse is coupled through diodes D18 to charge capacitor C13, to back bias diodes D19, and thus to turn off transistor T23. With transistor T23 off, the vibrato signal is not shunted to ground and reaches control lead 251. However, when the positive pulse which charged capacitor C13 disappears, capacitor C13 starts to discharge through resistor R73. As a result, after a short time, diodes D19 become forward biased, and transistor T23 starts to turn on to gradually shunt out more and more, and finally all, of the vibrato signal. In the delayed vibrato mode, with switch S9 closed and transistor T21 on, the positive signal on the emitter of transistor T20 is shunted to ground through transistor T21 and does not affect the delayed vibrato circuit.

To turn off the vibrato altogether, switches S8 and S9 are both open. Under such a condition, the bias path from −V2 through resistor R73 and diodes D19 is effective to turn transistor T23 on. When a keydown signal occurs, both the burble and delayed vibrato circuits function, but the effects cancel. The positive pulse charging capacitor C13 is more than offset by the negative pulse charging capacitor C14; and consequently transistor T23 stays on and continues to ground out the vibrato signal.

Preferably, vibrato/burble oscillator 30 is of the type shown in FIG. 7 of the above-referenced, allowed Schreier application so that the amplitude and frequency of the output of the oscillator can be controlled separately for the two modes. Typical component values for the circuitry of FIG. 2 are also given in the above-referenced Schreier application, and these component values are specifically incorporated herein by reference. It should, however, be understood that the above descriptions or preferred embodiments of this invention are given by way of example only and numerous modifications could be made therein without departing from the scope of the claims set forth below.

I claim:

1. In combination in an electronic musical instrument:

a plurality of selectively actuable control elements for controlling the sounding of musical notes;

detector means for detecting a selected condition of said control elements to produce a control signal;

means for producing musical tone signals including at least one voltage controlled oscillator;

oscillator means for producing electrical signals for modulating said voltage controlled oscillator;

a single gate circuit for controlling the application of said modulating electrical signals to said voltage controlled oscillator; and time constant circuit means coupled to said gate circuit and said detector means comprising a first time constant means responsive to said control signal to operate said gate only during an initial time interval to produce a musical effect called burble, a second time constant means responsive to said control signal to operate said gate only after a preselected time interval to produce a musical effect called delayed vibrato, and means for selecting one of said time constant circuits to be operative during any particular time interval.

2. The combination as claimed in claim 1, wherein said detector means produces said control signal whenever any of said control elements is actuated; said oscillator means is a free running oscillator; and said single gate circuit is coupled between said free running oscillator and said voltage controlled oscillator.

3. The combination as claimed in claim 2, wherein said single gate circuit comprises a transistor gate connected in shunt between the output of said free running oscillator and a gate bias circuit for biasing said transistor gate in a normally off condition ground; and said time constant circuit means further comprises:

a differentiating circuit for producing an output pulse in response to each new control signal; and a differential transistor driving circuit for producing a negative-going signal on a first output lead and a positive-going signal on a second output lead in response to each said output pulse;

said first time constant means comprising a bias circuit effective to overcome said gate bias circuit and turn on said transistor gate to shunt said modulating electrical signal to ground, and a first time constant circuit responsive to one of said positive-going and negative-going signals to overcome said first bias circuit and turn off said transistor gate for a short interval to permit said modulating electrical signal to pass;

said second time constant circuit means comprising a second time constant circuit responsive to the other of said positive-going and negative-going signals to overcome said second bias circuit and turn on said transistor gate for a short interval to shunt said modulating electrical signal to ground;

said selector means comprising a first switching circuit selectively operative to interrupt the output of said first time constant circuit means and a second switching circuit selectively operative to interrupt the output of said second time constant circuit means whereby (1) when said switching circuits are both operated, said transistor gate is off and the musical effect is continuous vibrato; (2) when said switching circuits are both unoperated, the effects of the first and second time constant circuits cancel and the musical effect is no vibrato; (3) when only the first switching circuit is operated, the musical effect is delayed vibrato; and (4) when only the second switching circuit is operated, the musical effect is burble.

4. The combination as claimed in claim 3, wherein each of said first and second switching circuits comprises a transistor gate coupled between the respective outputs of said first and second time constant means and ground, and a bias circuit including a switch for controlling the operation of said transistor gate.

* * * * *